US009987875B2

(12) United States Patent
Fuhse et al.

(10) Patent No.: US 9,987,875 B2
(45) Date of Patent: Jun. 5, 2018

(54) OPTICALLY VARIABLE SECURITY ELEMENT WITH TILT IMAGE

(75) Inventors: Christian Fuhse, Otterfing (DE); Manfred Heim, Bad Tölz (DE); Michael Rahm, Bad Tölz (DE); Günter Endres, München (DE)

(73) Assignee: GIESECKE+DEVRIENT MOBILE SECURITY GMBH, Munich (DE)

( * ) Notice: Subject to any disclaimer, the term of this patent is extended or adjusted under 35 U.S.C. 154(b) by 179 days.

(21) Appl. No.: 13/810,749

(22) PCT Filed: Jul. 18, 2011

(86) PCT No.: PCT/EP2011/003587

§ 371 (c)(1),
(2), (4) Date: Mar. 20, 2013

(87) PCT Pub. No.: WO2012/010286

PCT Pub. Date: Jan. 26, 2012

(65) Prior Publication Data

US 2013/0193679 A1 Aug. 1, 2013

(30) Foreign Application Priority Data

Jul. 21, 2010 (DE) ..... 10 2010 031 713

(51) Int. Cl.
*B42D 25/41* (2014.01)
*B42D 25/30* (2014.01)
(Continued)

(52) U.S. Cl.
CPC ..... *B42D 25/41* (2014.10); *B42D 15/00* (2013.01); *B42D 25/29* (2014.10); *B42D 25/30* (2014.10);
(Continued)

(58) Field of Classification Search
CPC ..... B42D 15/00; B42D 15/10; B42D 25/29; B42D 2035/36; B42D 2035/44;
(Continued)

(56) References Cited

U.S. PATENT DOCUMENTS 4,765,656 A * 8/1988 Becker ..... G06K 19/14 283/70
2005/0127663 A1* 6/2005 Heim ..... G03H 1/0011 283/72
(Continued)

FOREIGN PATENT DOCUMENTS

DE 103 58 784 A1 7/2005
DE 10 2005 062 132 A1 7/2007
(Continued)

OTHER PUBLICATIONS

International Search Report in PCT/EP2011/003587, dated Oct. 25, 2011.
(Continued)

*Primary Examiner* — Justin V Lewis
(74) *Attorney, Agent, or Firm* — Workman Nydegger

(57) ABSTRACT

(EN) The invention relates to an optically variable security element (20) for securing data carriers, having a flip image comprising first and second identifiers (24, 26) which can be detected from different first and second viewing directions (40, 42). According to the invention, the first and second identifiers (24, 26) of the flip image are present in an optically variable recording layer (30), which has a reflective layer (52) produced by a vacuum deposition process, and the security element (20) contains a viewing element screen (32) which is spaced apart from the recording layer (30) and which, when viewed from the first or second viewing direction (40, 42), reveals the first or second identifiers (24, 26), respectively.

19 Claims, 3 Drawing Sheets

(51) Int. Cl.
*B42D 15/00* (2006.01)
*B42D 25/29* (2014.01)

(52) U.S. Cl.
CPC ..... *B42D 2035/14* (2013.01); *B42D 2035/24* (2013.01); *B42D 2035/36* (2013.01); *B42D 2035/44* (2013.01); *Y10T 29/49826* (2015.01)

(58) Field of Classification Search
CPC .. B42D 2035/14; B42D 2035/24; G09C 3/00; Y10T 29/49826
USPC ..... 283/72, 74, 86, 94, 98, 107, 901
See application file for complete search history.

(56) References Cited

U.S. PATENT DOCUMENTS

2007/0030543 A1* 2/2007 Javidi ..... G02B 27/2214 359/9
2007/0063053 A1 3/2007 Bergmann et al.
2008/0042427 A1* 2/2008 Muke ..... B42D 25/41 283/112
2008/0160226 A1 7/2008 Kaule et al.
2009/0008923 A1 1/2009 Kaule et al.
2010/0109317 A1* 5/2010 Hoffmuller ..... B41M 3/14 283/91
2010/0182221 A1 7/2010 Kaule et al.
2010/0194532 A1 8/2010 Kaule
2011/0089676 A1* 4/2011 Hecker ..... G07D 7/002 283/70
2011/0101670 A1* 5/2011 Heim ..... G02B 5/283 283/85

FOREIGN PATENT DOCUMENTS

DE 10 2007 007 914 A1 8/2008
DE 10 2008 053 099 A1 4/2010
DE 10 2009 006 301 A1 7/2010
WO 2004/030928 A1 4/2004
WO 2006/087138 A1 8/2006
WO 2006/102700 A1 10/2006
WO 2006/110038 A2 10/2006
WO 2009/000528 A1 12/2008
WO WO 2009124898 A1 * 10/2009 ..... G07D 7/002
WO WO 2009149831 A2 * 12/2009

OTHER PUBLICATIONS

International Preliminary Report on Patentability in PCT/EP2011/003587, dated Jan. 22, 2013.

* cited by examiner

OPTICALLY VARIABLE SECURITY ELEMENT WITH TILT IMAGE

BACKGROUND OF THE INVENTION

A. Field of the Invention

The invention relates to an optically variable security element for safeguarding data carriers, with a tilt image of first and second markings which are recognizable from different first or second viewing directions. The invention also relates to a method for manufacturing such a security element and a data carrier equipped with such a security element.

B. Related Art

Data carriers, such as for example ID cards, credit cards, bank cards and the like are increasingly used in various service sectors, but also in the intra-company area. Here, they must normally fulfil two contrary conditions. On the one hand, due to their wide distribution they are a mass product the manufacturing of which is to be simple and cost-efficient. On the other hand, due to their legitimating function they are to offer maximum security against forgery or falsification. Also a visually appealing appearance of the security features used contributes to a high forgery resistance, since attractive security features are more heeded by the user and easier memorized. The multiplicity of the types of cards available, in particular of magnetic strip cards and chip cards, is an evidence for the many efforts and the various proposals as to how these contrary requirements can be combined with each other in suitable manner.

In this context, it is known to provide data carriers for safeguarding purposes with laser-engraved tilt images. In so doing, two or more different markings, for example a serial number and an expiration date, are laser-engraved into the card at different angles by an arrangement of cylindrical lenses. In so doing, the laser radiation produces a local blackening of the card body, which makes the engraved markings visually visible. Upon viewing there is visible depending on the angle of vision only the marking respectively engraved from this direction, so that by a tilting of the card parallel to the axis of the cylindrical lenses an optically variable tilt effect arises.

On these premises the invention is based on the object to create a security element of the above-mentioned kind, which is simple and cost-efficient to manufacture and simultaneously combines an attractive visual appearance with high forgery resistance.

According to the invention, in a generic security element the first and second markings of the tilt image are present in an optically variable recording layer which has a reflection layer produced by a vacuum deposition method. The security element further contains a viewing element grid spaced apart from the recording layer, which viewing element grid upon viewing from the first or second viewing direction shows the first or second markings.

By the combination of a viewing element grid with an optically variable recording layer there results an optically multivariable security element, in which the first optically variable effect of the tilt image and the second optically variable effect of the recording layer interact with each other and enhance each other visually. By the further feature, that the recording layer comprises a reflection layer produced by a vacuum deposition method, a simple and cost-effective incorporation of a desired tilt image in the security element is possible. The use of costly optically variable printing inks can thus be dispensed with. Although also the employment of comparatively elaborate laser technology for producing the markings is expedient, for the manufacturing of security elements according to the invention, however, not necessarily required. Rather, the markings can also be incorporated in the recording layer by a large-area mask exposure or by other demetallization methods, such as washing, etching, or oil ablation.

The proposed security element thus combines a high forgery resistance with an attractive visual appearance and a simple and cost-effective manufacturing.

Preferably, the optically variable recording layer contains a thin-film element with color shift effect. The thin-film element here advantageously has a reflection layer, an absorber layer and a dielectric spacer layer arranged between the reflection layer and the absorber layer. The first and/or second markings in this case are preferably formed by gaps in the absorber layer and/or the reflection layer and/or in the dielectric spacer layer.

In a development of the invention, the first and/or second markings respectively comprise first and second partial markings, the first partial markings being formed by gaps only in the absorber layer and the second partial markings by gaps both in the absorber layer and in the reflection layer, so that the security element shows different tilt images in plan view and in transmission.

In all configurations the first and second markings can be incorporated in the optically variable recording layer through the viewing element grid with laser radiation from different directions. If the markings respectively comprise the above-mentioned first and second partial markings, these are advantageously incorporated in the optically variable recording layer through the viewing element grid with laser radiation with different laser energy.

In an advantageous variant of the invention, the reflection layer of the optically variable recording layer is present over the full area at least outside the markings.

In a different, likewise advantageous variant of the invention, the reflection layer of the optically variable recording layer is gridded at least in partial regions outside the markings, and consists in these partial regions of a multiplicity of grid elements which are formed by gaps in a substantially opaque layer, or by substantially opaque, spaced-apart basic pattern elements. The gridded partial regions of the reflection layer advantageously form a motif in the form of patterns, characters, or a coding, which becomes visible upon viewing of the security element in transmission.

The grid elements of the reflection layer can be arranged regularly or also stochastically. A stochastic arrangement can be expedient in particular for avoiding undesirable moiré effects. In an advantageous configuration, the grid elements are configured circular, preferably with a diameter between 10 μm and 100 μm, or line-shaped, preferably with a width of 30 μm to 70 μm.

The viewing element grid is advantageously formed of a plurality of microlenses, in particular of cylindrical lenses or spherical lenses, or of a plurality of micro-concave mirrors.

The reflection layer preferably consists of a metal, in particular of aluminum. But also other metals, such as silver, nickel, copper, iron, chromium, gold, alloys of these or of other metals or further, strongly mirroring materials are conceivable. Preferably, the optically variable recording layer is separated from the viewing element grid by a transparent spacer layer.

The invention also includes a method for manufacturing an optically variable security element for safeguarding data carriers, wherein an optically variable recording layer with a reflection layer produced in vacuum deposition method is manufactured, in the optically variable recording layer first and second markings are incorporated, and the optically variable recording layer is combined with a viewing element grid at distance, which upon viewing from different first or second viewing directions shows the first or second markings, so that the first and second markings form a tilt image.

In an advantageous variant of the method, the first and second markings are incorporated in the optically variable recording layer through the viewing element grid with laser radiation from different directions.

In a different, likewise advantageous variant of the method, the first and second markings are incorporated in the optically variable recording layer by a washing, etching, or oil ablation method.

The invention also comprises a data carrier, in particular a branded article, a value document, an ID card and the like, with a security element of the described type. The invention offers special advantages with data carriers in the form of cards, such as credit cards, bank cards, cash payment cards, authorization cards, national identity cards or passport personalization pages.

Further embodiments as well as advantages of the invention will be explained hereinafter with reference to the Figures, in whose representation a rendition that is true to scale and to proportion has been dispensed with in order to increase the clearness. The different embodiments are not limited to employment in the concretely described form, but can also be combined with each other.

DETAILED DESCRIPTION

Figure 1:
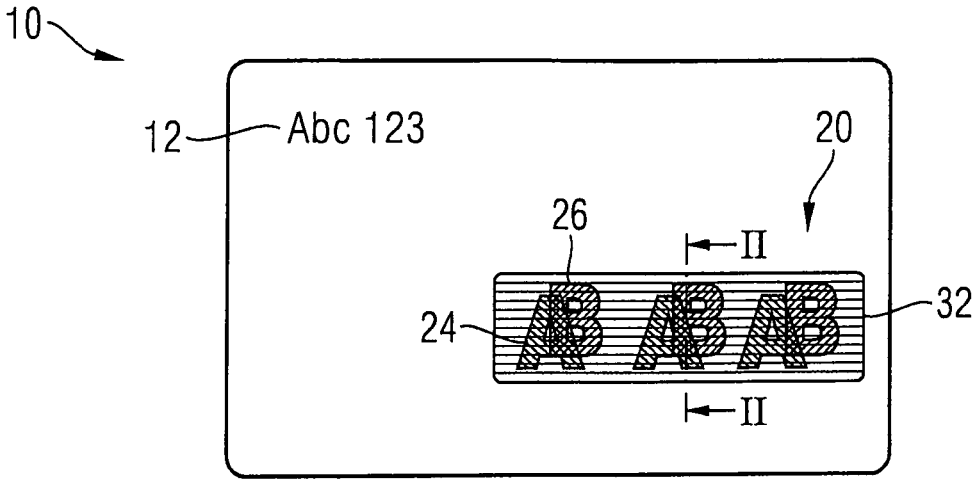
FIG. 1 a plan view of an identification card with a security element according to the invention, FIG. 2 schematically a cross-section of the card of FIG. 1 along the line II-II, FIG. 3 in (a) to (c) three embodiments of the invention, in which the optically variable recording layer is respectively formed by a thin-film element with color shift effect, FIG. 4 a security element with a gridded reflection layer according to an embodiment of the invention, FIG. 5 a security element with a reflection layer partly present over the full area and partly present in gridded fashion according to a different embodiment of the invention, and FIG. 6 a security element with a viewing element grid of a plurality of micro-concave mirrors according to a further embodiment of the invention.
Figure 2:
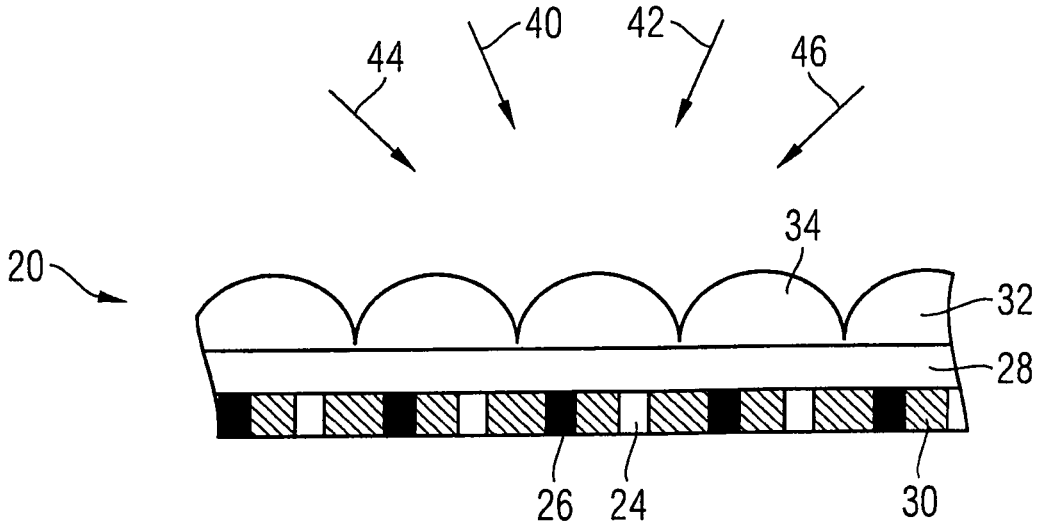

The invention will now be explained by the example of an identification card. FIG. 1 shows for this purpose a schematic representation of an identification card 10 in the ID-1 format, which is provided with a security element 20 according to the invention. FIG. 2 schematically shows a cross-section of the card 10 in the region of the security element 20 along the line II-II of FIG. 1.

For safeguarding purposes, the card 10 has, besides data 12 applied in a conventional way, an optically variable security element 20, which contains a tilt image of first and second markings 24, 26 which are schematically represented in FIG. 1 by the letter sequences "AAA" or "B B B". Unlike in the graphic representation of FIG. 1, upon viewing of the card 10 the markings 24, 26 are recognizable not simultaneously but only by tilting the card 10 in a respectively different tilt angle 40, 42.

The markings 24, 26 of the tilt image are present in an optically variable recording layer 30, for example a thin-film element with color shift effect. The recording layer 30 contains in particular a reflection layer produced by a vacuum deposition method, and thus allows a tilt image to be incorporated in a simple and cost-effective manner in the optically variable recording layer. Particularly advantageously, the reflection layer represents the reflector of a thin-film element with color shift effect.

The security element 20 further contains a viewing element grid 32 separated from the recording layer 30 by a spacer layer 28, said viewing element grid consisting of a plurality of parallel cylindrical lenses 34. The viewing element grid 32 in the embodiment is configured in the form of a horizontal lenticular grid, in other embodiments, however, it may also be configured for example in the form of a vertical lenticular grid.

The thickness of the spacer layer 28 and the focal length of the cylindrical lenses 34 are so mutually coordinated that the markings 24, 26 of the recording layer 30 lie approximately in the focal plane of the lenses 34.

In an advantageous configuration, the markings 24, 26 are written into the optically variable recording layer 30 by means of a pulsed infrared laser after the application of the lenticular grid 32. For this purpose, a laser beam is directed from various directions 40 or 42 onto the lenticular grid 32. The cylindrical lenses 34 focus the laser beam depending on the irradiation direction 40, 42 on different partial regions of the optically variable recording layer 30 and produce there the desired markings 24, 26 by the interaction of the laser radiation with the material of the recording layer 30. This interaction may consist in for example a local demetallization of the reflection layer and/or of the absorber layer of a color-shifting thin-film element, as will be explained hereinbelow more closely with reference to FIG. 3.

Upon viewing of the finished card 10, then from the viewing direction 40, because of the focusing effect of the cylindrical lenses 34, just the partial regions with the marking 24 written in from this direction are recognizable and join together to the letters "AAA" for a viewer. Accordingly, from the viewing direction 42 the partial regions with the markings 26 written in from this direction are recognizable and join together to the letters "B B B" for a viewer. From the flatter viewing directions 44, 46 the cylindrical lenses respectively show only partial regions of the optically variable recording layer 30, which were not modified by laser radiation and contain no markings.

Altogether, the security element 20 thus exhibits upon viewing an optically double-variable appearance. The first optically variable effect is given by the tilt effect of the tilt image 24, 26: If the card is tilted from the viewing direction 44 via the viewing directions 40 and 42 toward the viewing direction 46, so the viewer first sees the recording layer 30 without marking (viewing direction 44), from viewing direction 40 the first marking 24 becomes visible and from viewing direction 42 then the second marking 26, until from the viewing direction 46 finally again only the recording layer 30 without markings is to be recognized.

The second optically variable effect is given by the optical variability of the recording layer 30 itself and depends on the type of the chosen recording layer. Preferably, the second optically variable effect is a viewing angle-dependent color shift effect, which conveys to the viewer a color impression that changes with the viewing direction. The color impression of the recording layer may change upon tilting of the security element, for example from green to blue, from blue to magenta, or from magenta to green.

Figure 3A:
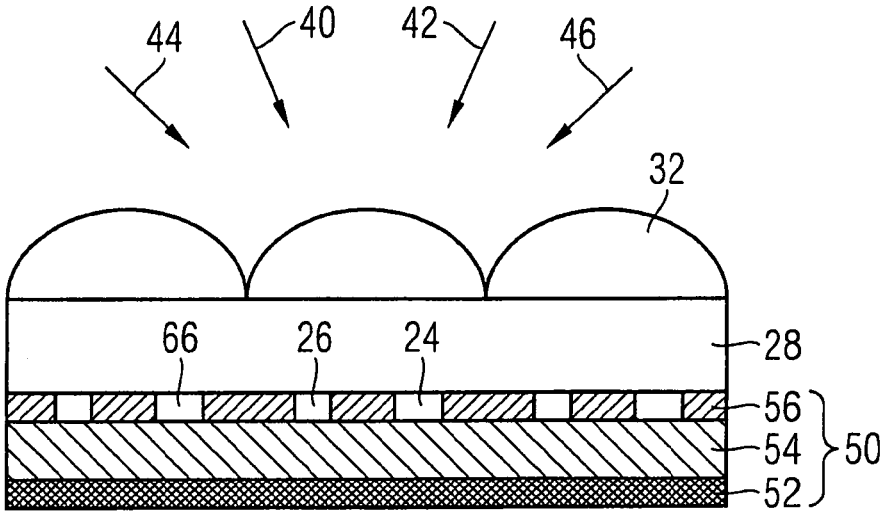
Figure 3B:
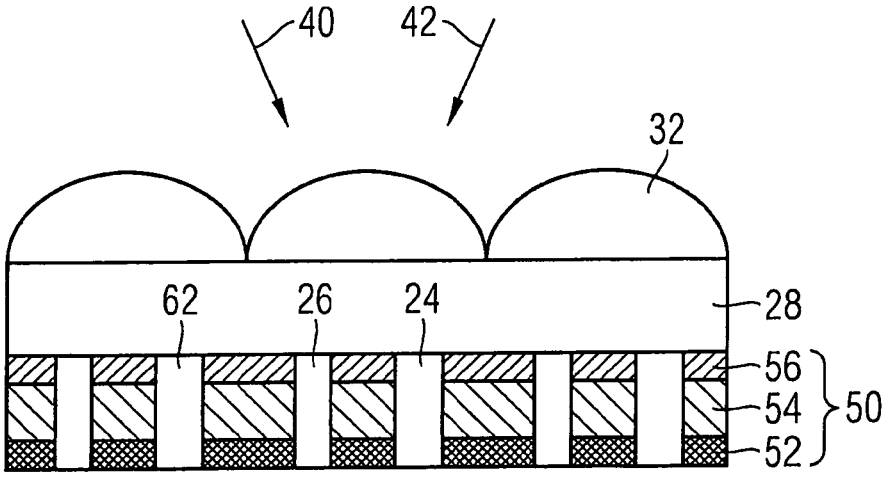
Figure 3C:
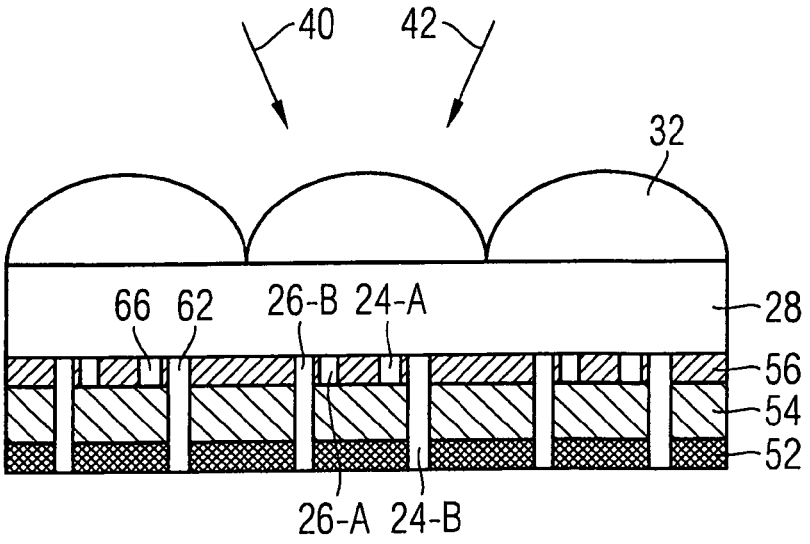

FIG. 3 shows in (a) to (c) three embodiments of the invention, wherein the optically variable recording layer is respectively formed by a thin-film element 50 with color shift effect, which has a reflection layer 52, an absorber layer 56 and a dielectric spacer layer 54 arranged between the reflection layer and the absorber layer.

In the embodiment of FIG. 3(*a*), the first and second markings 24, 26 are respectively formed by gaps 66 in the absorber layer 56 of the thin-film element 50. Such gaps 66 can be produced for example by lasering of the thin-film element 50 with relatively low laser energy. Upon viewing of the security element of FIG. 3(*a*) in plan view, the demetallized gaps 66 of the absorber layer 56 appear without color shift effect in the color of the reflection layer 52, while the regions of the thin-film element 50 lying outside the gaps 66 show the specified color shift effect.

For example, the markings 24, 26 formed by the demetallized gaps 66 can join together to silvery lustrous letters "A A A" for a viewer upon viewing the security element in plan view from the viewing direction 40 and to silvery lustrous letters "B B B" from viewing direction 42, in each case in front of a color-shifting background. From other viewing directions 44, 46, neither the letters "A A A" of the marking 24 nor the letters "B B B" of the marking 26 but only the color-shifting background of the thin-film element 50 are recognizable.

The security element of FIG. 3(*a*) is designed to be viewed in plan view and can be arranged in particular in an opaque region of a card 10 or of another data carrier.

In the embodiment of FIG. 3(*b*), the first and second markings 24, 26 are respectively formed by gaps 62 both in the absorber layer 56 and in the reflection 52 of the thin-film element 50. Such gaps 62 can be produced for example by lasering of the thin-film element 50 with relatively high laser energy, so that not only the absorber layer 56 but also the reflection layer 52 is demetallized in certain regions.

Upon viewing of the security element of FIG. 3(*b*) in plan view, the demetallized gaps 62 of the absorber layer 56 and of the reflection layer 52 appear colorless, while the regions of the thin-film element lying outside the gaps 62 show the specified color shift effect. Since the gaps 62 also extend through the reflection layer 52, they are visible not only in plan view but also in transmission and then appear light against the dark background of the opaque reflection layer 52.

For example, the markings 24, 26 formed by the demetallized gaps 62 can join together to the numbers "1 1 1" for a viewer upon viewing the security element from the viewing direction 40 and to the numbers "2 2 2" from viewing direction 42. In plan view, the numbers appear colorless against the color shifting background of the thin-film element 50, in transmitted light they appear light against a dark background of the reflection layer 52.

The security element of FIG. 3(*b*) is designed to be viewed both in plan view and in transmission, and can be arranged in particular in a transparent or translucent window region or above an opening of a card 10 or of another data carrier.

By a suitable variation of the laser parameters, for example of the laser energy, there can also be produced two different tilt images for viewing in plan view and in transmission, as illustrated in FIG. 3(*c*). There, at first, by subjecting the thin-film element to low laser energy gaps 66 were produced only in the absorber layer 56 of the thin-film element 50, which gaps respectively form first partial markings 24-A and 26-A of the markings 24, 26. By subjecting the thin-film element to higher laser energy, furthermore, gaps 62 both in the absorber layer 56 and in the reflection layer 52 of the thin-film element 50 were produced, which gaps respectively form second partial markings 24-B and 26-B of the markings 24, 26.

Upon viewing of the security element of FIG. 3(*c*) in plan view, the demetallized gaps 66 of the absorber layer 56 appear without color shift effect in the color of the reflection layer 52, while the demetallized gaps 62 of the absorber layer 56 and of the reflection layer 52 appear colorless. The regions of the thin-film element lying outside the gaps 62 and 66 show the specified color shift effect. Upon viewing in transmission, however, only the gaps 62 which also extend through the reflection layer 52 are visible, as described in FIG. 3(*b*). The security element of FIG. 3(*c*) thus shows two different tilt images in plan view and in transmission.

For example, the partial markings 24-A, 26-A formed by the gaps 66 may supplement each other to the letters "A A A" from the viewing direction 40 and to the letters "B B B" from the viewing direction 42, and the partial markings 24-B, 26-B formed by the through-going gaps 62 may supplement each other to the numbers "1 1 1" from the viewing direction 40 and to the numbers "2 2 2" from the viewing direction 42.

In plan view the viewer then sees the partial markings 24-A, 26A formed by the gaps 66 silvery lustrous with the color impression of the reflection layer 52 and the partial markings 24-B, 26-B formed by the through-going gaps 62 colorless, thus perceives upon tilting the security element a tilt image from "A1 A1 A1" to "B2 B2 B2" against a color-shifting background, the letters respectively appearing silvery lustrous and the numbers colorless.

In transmission, the gaps 66 present only in the absorber layer 56 are not to be recognized, while the partial markings 24-B, 26-B formed by the gaps 62 appear light against the dark background of the reflection layer 52. In transmission the viewer thus perceives upon tilting the security element a tilt image of light numbers from "1 1 1" to "2 2 2" against a dark background.

The reflection layer of the optically variable recording layer can be present outside the markings not only over the full area, as shown in the FIGS. 2 and 3, but can there also be gridded at least in partial regions.

Figure 4:
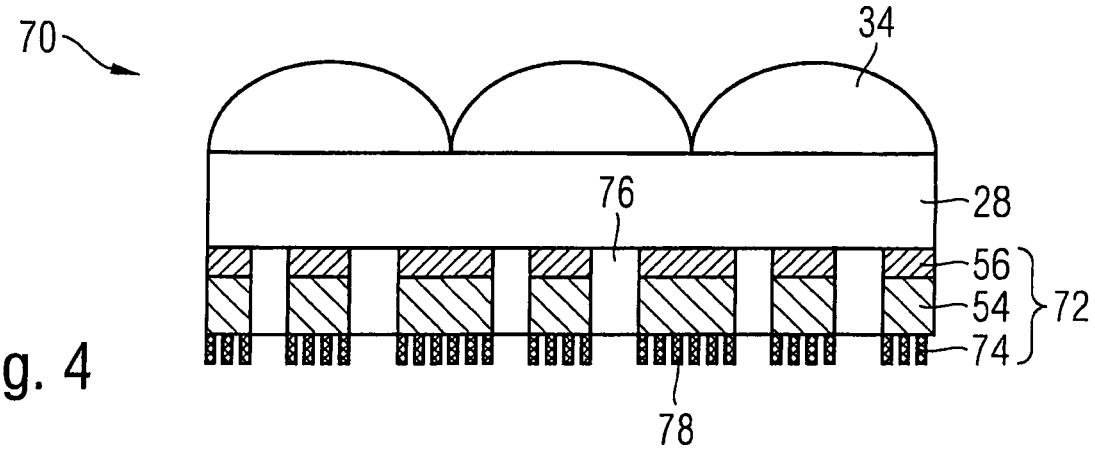

FIG. 4 shows for this purpose a security element 70 having an optically variable recording layer in the form of a color shifting thin-film element 72 having a gridded reflection layer 74, an absorber layer 56, and a dielectric spacer layer 54. The first and second markings 24, 26 are formed, similar to those in the embodiment of FIG. 3(*b*), by gaps 76 both in the absorber layer 56 and in the reflection layer 72 of the thin-film element 70.

In contrast to the embodiment of FIG. 3(*b*), the reflection layer 74 is gridded outside the markings 24, 26 and consists of a multiplicity of spaced-apart grid elements 78. Therefore, in transmission the security element 70 is not opaque also outside the markings, but rather weakly transparent. For example, the grid elements 78 can be configured circular with a diameter between 10 μm and 100 μm. The gridding can be configured such that the grid elements 78 are visible in direction-dependent fashion, but, however, that averaged over several lens diameters a non-direction-dependent transmittance of the reflection layer 74 is present. Here, a stochastic distribution of the grid elements 78 has proved advantageous, in order to avoid undesirable moiré effects.

In such a configuration, the security element can also be combined with further for example printed plan-view/transmission-view features, such as printed information disappearing in transmission. The latter can also be provided on the back side of the security element.

Figure 5:
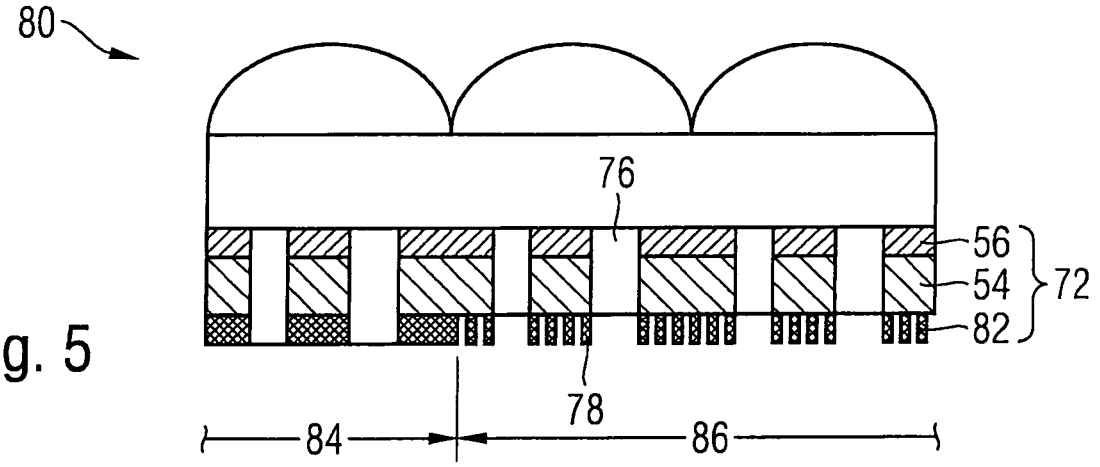

The reflection layer of the optically variable recording layer can also be present partly over the full area and partly in gridded fashion. FIG. 5 shows for this purpose a security element 80 which to a great extent is constructed like the security element 70 of FIG. 4. In contrast to this, the recording layer 72 of the security element 80 contains a reflection layer 82, which in first partial regions 84 is present over the full area and in second partial regions 86 in gridded fashion. The gridded partial regions 86 here form by their outline form a motif which, due to the weak transparency of the gridded partial regions 86, in transmission are visible against the opaque background of the full-area partial regions 84. The security element 80 thus has, in addition to the optically double-variable appearance, a plan-view/transmission-view effect, namely the motif of the gridded partial regions 86 which appears in transmission. By different sizes or distances of the grid elements 78 this motif can also be formed with a plurality of shades of grey.

The markings 24, 26 can be incorporated in the recording layer also in a different way, instead of the described lasering through the lenses 34, for example by a demetallization of an absorber or reflection layer by a washing, etching, or oil ablation method. Also, an optical ablation can be done for example by the recording layer being structured via a high-resolution mask with a single exposure.

Figure 6:
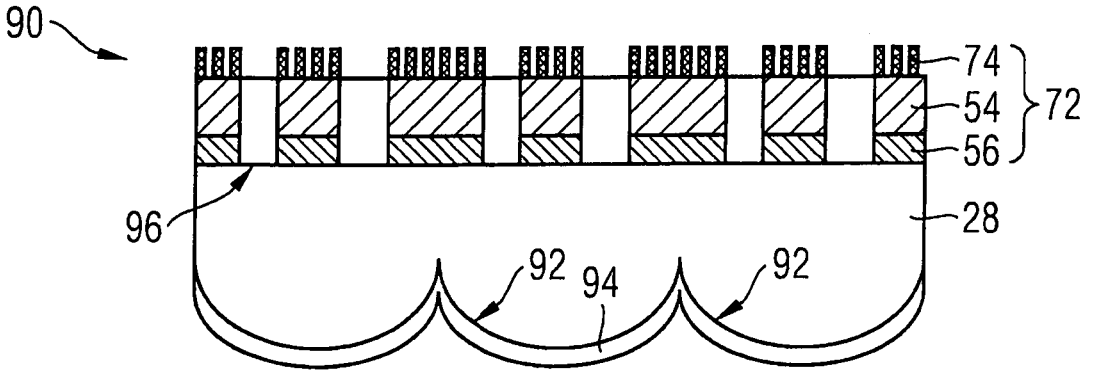

As viewing elements there are suitable, in addition to the hitherto described lenses 34, also micro-concave mirrors 92. With reference to FIG. 6, a security element 90 contains a grid of a plurality of micro-concave mirrors 92, which are separated via a spacer layer 28 from the optically variable recording layer 72.

The recording layer 72 must be at least partly transparent in this variant of the invention, which can be ensured for example by using a gridded reflection layer 74. Further, the recording layer 72 is to be arranged such that its optically variable effect is visible from the lower side 96, i.e. the side facing the micro-concave mirrors 92, as shown in FIG. 6.

In a further variant of the invention which is not represented, the optically variable effect is from the upper side.

Also in the variant of the invention having micro-concave mirrors 92, a motif can be written into the optically variable recording layer 72 by means of laser exposure in the way described above, or the recording layer 72 can be structured by a washing, etching, or oil ablation method. Further, the reflector 94 of the micro-concave mirrors 92 can be configured as an optically variable layer and can be formed in particular by a color-shifting thin-film system. The reflector 94 of the micro-concave mirrors 92 can also be partly or completely gridded, in order to produce see-through effects. For the gridding of the reflector 94 there are the same possibilities here as for the gridded reflection layer 74, so that in this respect reference is made to the above explanations. In particular, the gridded regions of the reflector 94 can form a motif and/or make visible additional security features provided on the back side of the security element 90.

In further configurations, the tilt images of the recording layer can show a magnification and/or depth effect as known from moiré magnifier systems. The production and properties of such micro-optic representation arrangements are described for example in the international applications WO 2009/00528 A1 and WO 2006/087138 A1, whose disclosure is incorporated in the present description in this regard. Upon viewing of a security element of the invention with moiré magnification effect, there can then be seen from the respective tilt angle a marking, which depending on the configuration appears to float in front of or behind the plane of the security element.

The invention claimed is:

1. An optically variable security element for safeguarding data carriers, having a viewing element grid spaced apart from an optically variable recording layer by a spacer layer, the optically variable recording layer comprising:

a colored reflection layer;

an absorber layer arranged to produce a color shift effect; and a dielectric spacer layer arranged between the reflection layer and the absorber layer;

wherein the recording layer defines at least one first partial gap and one complete second gap, configured such that upon viewing through the viewing element grid in a plan view from a first tilt or a second tilt angle shows a first or second marking, respectively, along with a color shift effect, wherein the at least one first partial gap extends through the absorber layer; and wherein the at least one complete second gap extends through the absorber layer, the dielectric layer, and the reflection layer, the at least one complete second gap is configured to produce a transmission effect.

2. The security element according to claim 1, wherein the optically variable recording layer contains a film element with the color shift effect.

3. The security element according to claim 2, wherein the film element comprises the reflection layer, an absorber layer and a dielectric spacer layer arranged between the reflection layer and the absorber layer, and the first and/or second markings are formed by at least gaps in two or more layers of: the absorber layer; the reflection layer; and the dielectric spacer layer.

4. The security element according to claim 3, wherein either or both the first and second markings respectively comprise first and second partial markings, the first partial markings being formed by gaps only in the absorber layer and the second partial markings being formed by gaps both in the absorber layer and in the reflection layer, so that the security element shows different tilt images in plan view and in transmission.

5. The security element according to claim 1, wherein the first and second markings are incorporated in the optically variable recording layer through the viewing element grid by laser radiation from different directions.

6. The security element according to claim 4, wherein the first and second markings are incorporated in the optically variable recording layer through the viewing element grid with laser radiation from different directions, and further wherein the first and second partial markings are incorporated in the optically variable recording layer through the viewing element grid by laser radiation with different laser energy from laser energy for the first and second markings.

7. The security element according to claim 1, wherein the reflection layer of the optically variable recording layer is present over a full area at least outside the markings.

8. The security element according to claim 1, wherein the reflection layer of the optically variable recording layer is gridded at least in partial regions outside the markings and comprises in these partial regions a multiplicity of grid elements which are formed by gaps in a substantially opaque layer, or by substantially opaque, spaced-apart pattern elements.

9. The security element according to claim 8, wherein the gridded partial regions form a motif in the form of patterns, characters, or a coding.

10. The security element according to claim 8, wherein the grid elements are arranged stochastically.

11. The security element according to claim 8, wherein the grid elements are configured to be circular or line-shaped.

12. The security element according to claim 1, wherein the viewing element grid comprises of a plurality of microlenses, or of a plurality of micro-concave mirrors that have a reflector configured as an optically variable layer and that is formed by a color-shifting thin-film system.

13. The security element according to claim 1, wherein the optically variable recording layer is separated from the viewing element grid by a transparent spacer layer.

14. The security element according to claim 4, wherein the first and second markings are incorporated in the optically variable recording layer through the viewing element grid with relatively high laser energy radiation from different directions, and further wherein the first and second partial markings are incorporated in the optically variable recording layer through the viewing element grid by laser radiation with relatively lower laser energy.

15. The security element according to claim 1, wherein the viewing element comprises cylindrical lenses, and a thickness of the spacer layer and a focal length of the cylindrical lenses are configured such that the first partial and second complete gaps lie in a focal plane of the cylindrical lenses.

16. The security element according to claim 1, wherein the reflection layer comprises both a full layer and a grid pattern in areas surrounding the gaps.

17. The security element according to claim 1, wherein the grid pattern of the reflection layer comprises circular grid elements with a diameter between 10 μm and 100 μm.

18. A data carrier, comprising the security element recited in claim 1.

19. An optically variable security element for safeguarding data carriers, comprising:

a tilt image of first and second markings which are recognizable from different first or second tilt angles, wherein the first and second markings of the tilt image are present in an optically variable recording layer including a film element comprising a reflection layer produced by a vacuum deposition method, an absorber layer and a dielectric spacer layer arranged between the reflection layer and the absorber layer, the first markings formed by at least one partial gap in the absorber layer that extends therethrough and which upon viewing from the first or second tilt angles shows the first markings along with a color shift effect, and wherein second markings formed by at least one complete gap extend through the absorber layer, the dielectric layer, and the reflection layer, wherein upon viewing the at least one complete gap from the first or second tilt angles shows the second markings along with a color shift effect; and a viewing element grid spaced apart from the recording layer, which upon viewing from the first or second tilt angles shows the first or second markings along with a color shift effect, wherein the viewing element grid comprises a plurality of microconcave mirrors which are separated from the optically variable recording layer by a spacer layer.

* * * * *